United States Patent [19]

Smith, Jr.

[11] 4,291,875

[45] Sep. 29, 1981

[54] SPLIT-SINGLES STICK FOR TENNIS COURTS

[76] Inventor: Allan J. Smith, Jr., 1621 Old Springhouse La., Dunwoody, Ga. 30338

[21] Appl. No.: 56,322

[22] Filed: Jul. 10, 1979

[51] Int. Cl.[3] ..... A63B 71/02

[52] U.S. Cl. ..... 273/29 B

[58] Field of Search ..... 273/29 R, 29 B, 29 A, 273/29 BB, 29 BC, 29 BD, 29 BE, 29 BF, 29 BG, 30; 256/33, 35, 36, DIG. 2, DIG. 3

[56] References Cited

U.S. PATENT DOCUMENTS

| | | | |
|---|---|---|---|
| 409,172 | 8/1889 | Corell | 256/35 |
| 1,939,841 | 12/1933 | Briggs | 273/29 BB |
| 3,860,240 | 1/1975 | Koch | 273/29 B |

FOREIGN PATENT DOCUMENTS

| | | | |
|---|---|---|---|
| 420693 | 7/1934 | United Kingdom | 273/29 BB |

*Primary Examiner*—Richard C. Pinkham

*Assistant Examiner*—T. Brown

*Attorney, Agent, or Firm*—Newton, Hopkins & Ormsby

[57] ABSTRACT

An improvement in a tennis singles stick for elevating to the prescribed height at the required distance outside the singles play area a net supported across a doubles court to convert the doubles court to regulation singles play. The embodiment of the invention includes two halves supported in assembled juxtaposed vertical relationship with the net therebetween. The halves are oppositely dimensioned adjacent to their tops to form surfaces which cooperate for receiving the top cable of the net and the band covering the same. A fastener is provided for releasably securing together the two halves. Another embodiment includes a unitary stick having upper and lower channels vertically spaced within the same plane and which are interconnected by a rigid support member positioned out of that vertical plane. The upper channel is dimensioned to receive the top cable and band and the lower channel to receive the bottommost horizontal strand of the net.

3 Claims, 7 Drawing Figures

SPLIT-SINGLES STICK FOR TENNIS COURTS

BACKGROUND OF THE INVENTION

1. Field of the invention

This invention relates to regulation tennis net supports and, more particularly, to an improved tennis singles stick.

2. Description of the Prior Art

The Official Rules of tennis, among other things, states that the tennis net, which spans the width of the court and divides the playing surface into two equal halves, must be 42 inches above the playing surface at a distance of 36 inches outside of the playing surface. Inasmuch as most tennis courts are constructed in the doubles configuration, the permanent posts for supporting the net are installed for doubles competition in accordance with the official height and distance regulations. However, singles competition on a doubles court requires the use of temporary net posts or single sticks in order to elevate the net to the required height the required distance outside of the narrower playing surface used for singles tennis.

The prior art singles stick usually is a unitary wooden element which is 42 inches tall and has a V-shaped notch formed on the top of the stick. The width and depth dimensions of the prior art stick receive little attention. Installation of that stick requires lifting the net over the top of the stick and inserting the top cable of the net into the V-notch.

The use of that prior art stick invariably results in at least two violations of the Official Rules. First, the net is elevated above the regulation height and second, the playing court is no longer divided by the net into two equal halves since the net is displaced from a vertical plane along a portion of its length.

Further, the prior art singles sticks are easily moved from their position by the ball in flight or a competitor or one of the ball assistants inadvertently hitting the stick.

SUMMARY OF THE INVENTION

The above disadvantages are overcome by the present invention, the first embodiment of which comprises a singles stick constructed of two equally dimensioned halves which have oppositely directed, complimentary surfaces adjacent their top which define for receiving the net cable and ribbon band. Means is provided to releasably secure the halves together along their opposed faces so as to sandwich the net therebetween.

The halves are each 42 inches high and have an arcuate groove longitudinally extending along the juncture of the horizontal top of the half with its vertical face. An L-shaped slot longitudinally extends along each opposed face immediately below the respective groove.

One form of the securing means includes a pair of threaded bolts laterally extending through holes in the halves and being secured on their distal ends by wing nuts. Another embodiment of the securing means includes a pair of spring clips which are detachably connected to the top and bottom of the stick.

In its operation, the two halves are placed on opposite sides of the net, 36 inches outside the singles playing surface. The halves are secured together by means of the nuts and bolts or the clips which engage the top and the bottom of the stick, thereby sandwiching the net between the two halves. The net cable rests in the circular cavity formed by the two arcuate grooves with the net band being received within the channel formed by the opposed L-shaped slots. A similarly constructed stick is placed in its operative position 36 inches from the other side of the singles playing surface in order to conform a doubles court to regulation singles play.

Another embodiment of the present invention comprises two halves as described above which are joined at their lower ends by means of a hinged link. The securing means includes a threaded bolt which joins together the two halves in their assembled configuration adjacent the top of the stick.

A further embodiment of the improved singles stick of the present invention comprises a unitary element having upper and lower channels spaced within the same vertical plane and interconnected by means of a rigid support positioned out of that vertical plane. The upper channel has an open top to receive therein the top cable and band of the tennis net. The lower channel has an open bottom and is dimensioned to engage the lowermost horizontal strand of the net.

By means of the various embodiments of the present invention, the net height or distance from the top of the net cable to the ground is at the regulation height of 42 inches, the net remains in a vertical plane and the stick is not dislodged by the action of the ball or the players.

Therefore, it is the primary object of the present invention to provide an improved single tennis stick.

Another object of the present invention is to provide a singles tennis stick which is economical to manufacture and easy to operate.

A further object of the present invention is to provide a singles tennis stick which supports the net in a vertical plane at the regulation height.

DETAILED DESCRIPTION OF THE ILLUSTRATIVE EMBODIMENTS

A. First Embodiment

Figure 1:
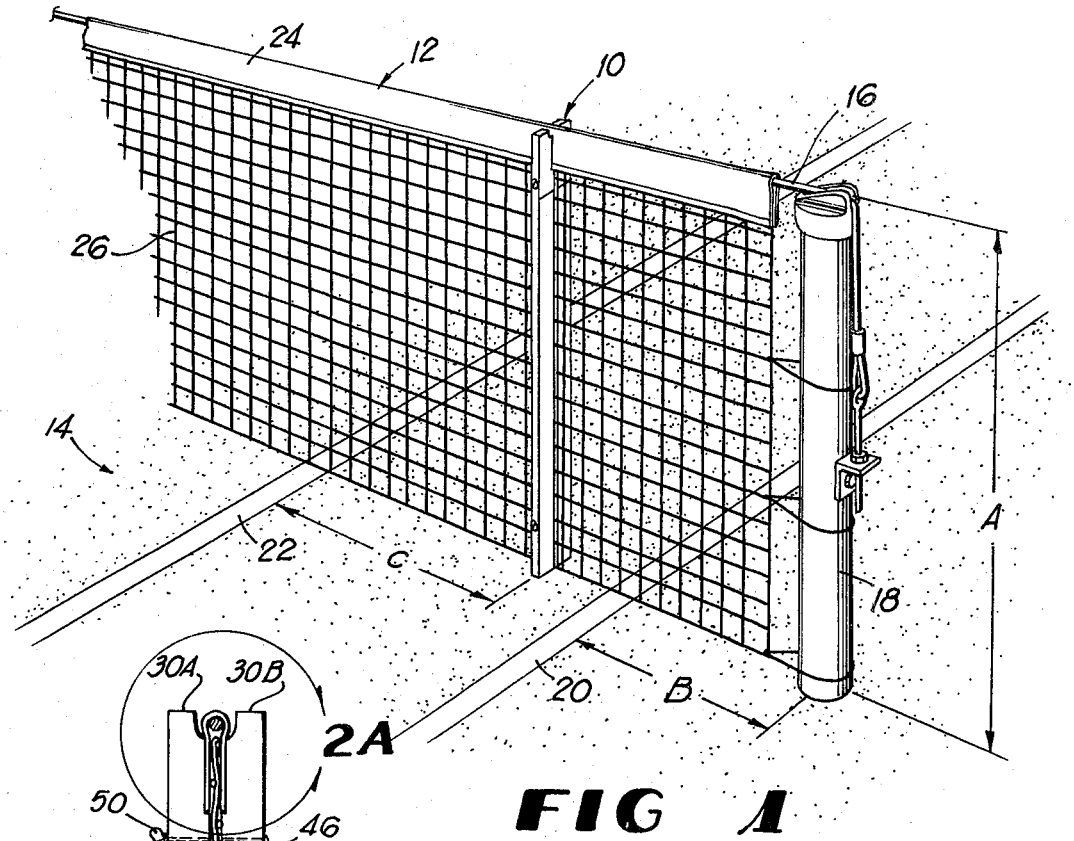
FIG. 1 is a partial perspective view of a doubles tennis court with the first embodiment of the present invention in its operative position.

Referring to FIG. 1, the numeral 10 denotes generally the first embodiment of the present invention for use with a tennis net 12 which bisects a tennis court 14 that has a configuration for doubles tennis play. According to the *Code of Rules and Cases and Decisions*, which is referred to as the tennis Official Rules and which is the Official Code of the International Tennis Federation, the net 12 is supported from a cord or metal cable 16, the ends of which are attached to or pass over the tops of two posts (one of which is shown as numeral 18) which are 42 inches high, the center of each post 18 being 3 feet outside of the court 14 on each side thereof. Arrow A represents the regulation height of post 18 which is 42 inches and arrow B is the regulation distance from the centerline of post 18 to the outside of the doubles line 20, or 3 feet.

In order to play a singles match on doubles court 14, the net 12 must still be elevated 42 inches high, 3 feet from the outside of the singles court, the boundary of which is shown by line 22. Therefore, arrow C which is the distance from the outside of line 22 to the centerline of stick 10 must be 3 feet and the stick 10 must elevate the net 12 to the regulation height a distance of arrow A.

The net 12 is of regulation construction, having a white band or tape 24 extending along the top of the net 12 which covers the cable 16 and which is attached along its bottom edges to the upper portion of the strands of interconnected vertical and horizontal netting 26. The width of band 24 may vary from not less than 2 inches to not more than 2½ inches.

Figure 3:
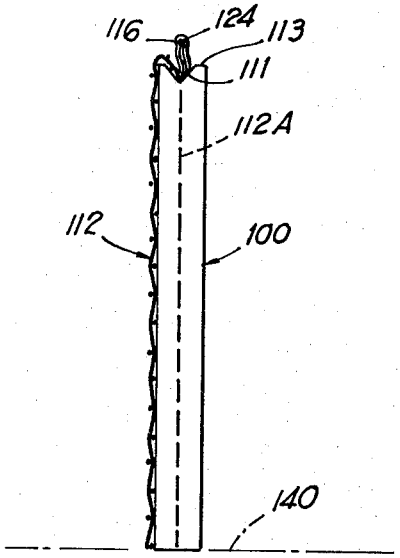
FIG. 3 is a side elevational view of the prior art singles stick in operation.

The prior art singles stick 100 is shown in FIG. 3 and comprises a unitary wooden element, 42 inches in length. A V-shaped notch 111 is formed in the top 113 to accommodate the cable and the band 124 of the net 112. When the cable 116 is inserted into the notch 111, the band 124 bunches up within the notch 111, thereby displacing the cable 116 above the regulation 42 inches and, as seen in FIG. 3, displacing the net 112 laterally from the vertical centerline 112A, resulting in one side of the court 140 being unequal in length to the other side. Thus, the use of the stick 100 invariably causes a violation of one or more of the regulations regarding the net.

Figure 2:
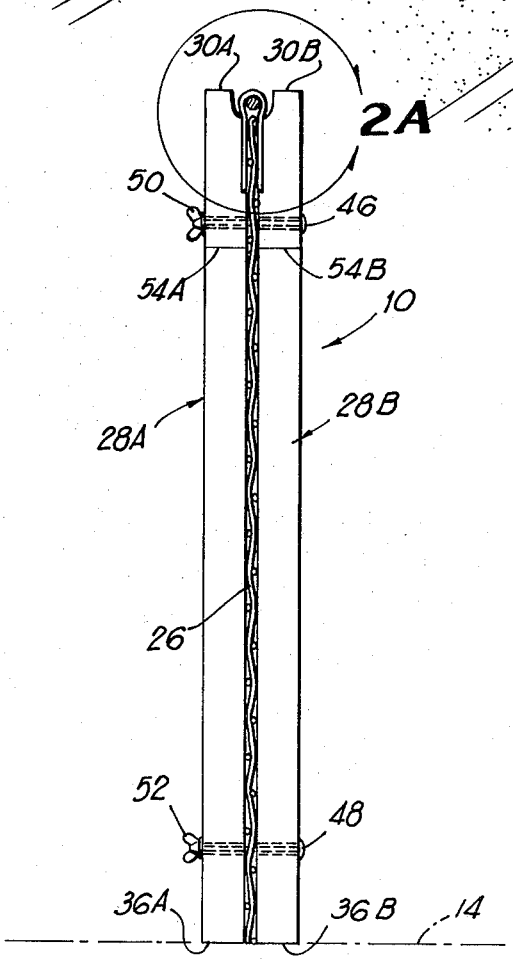
FIG. 2 is a side elevational view of the first embodiment in its assembled configuration.
Figure 2A:
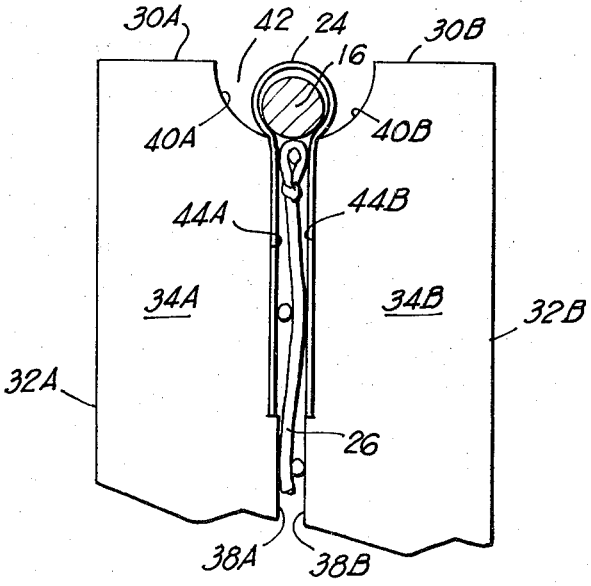
FIG. 2A is an inset taken along circle 2A in FIG. 2.

A detailed view of stick 10 in its operative assembled position is seen in FIGS. 2 and 2A. The stick 10 includes two equally dimensioned halves 28A, 28B which have smooth exterior surfaces and which can be constructed out of any suitable material, such as wood or metal. The halves 28A, 28B include horizontal tops 30A, 30B; vertical front walls 32A, 32B; parallel, vertical sidewalls 34A, 34B; flat bottom surfaces 36A, 36B; and opposed parallel, vertical interior faces 38A, 38B. Longitudinally extending, oppositely directed, arcuate grooves 40A, 40B are formed in halves 28A, 28B at the juncture of tops 30A, 30B and faces 38A, 38B, the two grooves 40A, 40B defining a semi-circular cavity 42. Opposed, longitudinally extending L-shaped slots 44A, 44B are formed on faces 38A, 38B below grooves 40A, 40B and define a channel for the band 24.

The radius of each groove 40A, 40B is ⅜ of an inch to define a cavity 42 which is ¾ of an inch in diameter in order to receive therein the cable 16 which has a maximum diameter of ⅓ of an inch. The depth of each slot 44A, 44B is 1/16 of an inch to form a channel ⅛ of an inch wide. The distance from the bottom of the slots 44A, 44B to the tops 30A, 30B is 2½ inches. The width of the halves 28A, 28B are ¾ of an inch and are ¾ of an inch deep, so that in its assembled form, the width of stick 10 is 1½ inches.

Referring to FIG. 2, the halves 28A, 28B are releasably secured together along faces 38A, 38B by means of a pair of laterally extending, centrally disposed 2 inch long carriage bolts 46 and 48 which have wing nuts 50, 52 threadedly received on their respective distal ends. Bolt 48 is positioned 13 inches from bottom surfaces 36A, 36B and bolt 46 is located 38 inches from surfaces 36A, 36B.

Reference marks 54A, 54B are horizontally scored along the exterior surfaces of side walls 34A, 34B. The distance from the bottom surfaces 36A, 36B to the marks 54A, 54B is 36 inches.

In the operation of the first embodiment, one of the halves 28A, 28B is vertically positioned at the center of the playing surface 14 in order to check the height of net 12 at its center, which should be 36 inches. The top of the net 12 at that point should be in horizontal alignment with reference mark 54A or 54B.

Once the height of net 12 is established, the operative position of the stick 10 is established by abutting a bottom surface 36A or 36B against the outside of singles line 22 so that the half 28A or 28B is perpendicular to the line 22 and reference mark 54A or 54B is visible thereby indicating arrow C, the required 3 feet from the outside of the singles court where the stick 10 is to be assembled on the net 12.

The halves 28A, 28B in their disassembled state are placed on opposite sides of net 12 at the prescribed distance from line 22 so that opposed faces 38A, 38B are in vertical alignment, bottom surfaces 36A, 36B being in abutting engagement with the tennis court 14. The net cable is positioned so that it is nesting within cavity 42, the band 24 vertically extending within the channel defined by slots 44A, 44B. The halves 28A, 28B are then secured together by the bolts 46, 48 and respective nuts 50, 52, the netting 26 below band 24 being compressed between faces 38A, 38B. Another stick 10 is placed in operative position on the opposite side of the court 14.

At the regulation distance C from the singles line 22, the height of net 12 is approximately 40¾ inches above court 14. When in their operative, assembled position, the halves 28A, 28B raise the net 12 to its regulation height A (42 inches) at the regulation distance C.

As seen in FIG. 2A, the cavity 42 is dimensioned to receive the cable 16 so that the top of the band 24 is flush with tops 30A, 30B. The channel defined by slots 44A, 44B is of sufficient dimension to receive the band 24 therein.

The compression of the net 12 by the assembled halves 28A, 28B renders the stick 10 nearly immobile and provides resistance to movement created by a ball in flight, the players or the ball assistants. Additionally, the sticks 10 do not interfere with the natural hanging characteristics of net 12. The net 12 remains in a vertical plane, the height of the net 12 being maintained at 42 inches.

B. Second Embodiment

Figure 4:
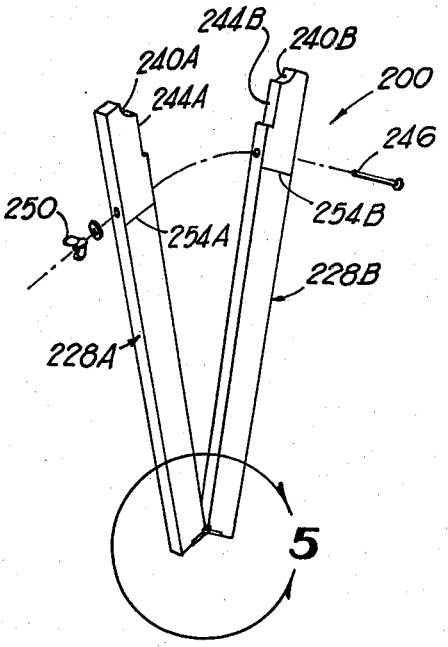
FIG. 4 is a perspective view of the second embodiment of the present invention with certain parts exploded for clarity.
Figure 5:
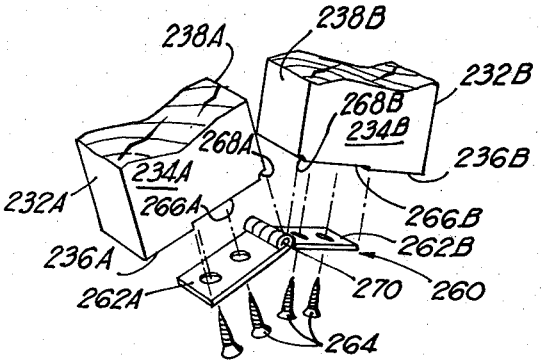
FIG. 5 is an inset taken along circle 5 in FIG. 4.

The second embodiment of the present invention is shown in FIGS. 4 and 5 and is denoted by the numeral 200. It includes halves 228A, 228B which are equal in dimension and function as halves 28A, 28B. The halves 228A, 228B have front walls 232A, 232B, side walls 234A, 234B; flat bottom surfaces 236A, 236B; and opposed, interior faces 238A, 238B.

The top of the stick 200 is shaped to receive the top of the net as with stick 10 and includes grooves 240A, 240B; and L-shaped slots 244A, 244B. The halves 228A, 228B are releasably secured together by means of bolt 246 and nut 250.

A means is provided for interconnecting the halves 228A, 228B along bottom surfaces 236A, 236B and includes a conventional double leaf hinge 260 formed of two plates 262A, 262B which are secured to the bottom surfaces 236A, 236B by screws 264. Slots 266A, 266B laterally extend through halves 228A, 228B adjacent interior faces 238A, 238B and equal in dimension to plates 262A, 262B. The slots 266A, 266B terminate, respectively, in laterally extending grooves 268A, 268B which define an opening to receive the hinge joint 270. When hinge 260 is attached to the halves 228A, 228B, the bottom surfaces of the plates 262A, 262B are flush with bottom surfaces 236A, 236B.

In the operation of the stick 200, the regulation 3 feet distance from the outside of the singles line is determined by using reference marks 254A or 254B similar to the technique described above the reference marks 54A and 54B. The stick 200 is placed at that point on one side of the net in its unassembled configuration. One of the halves 228A or 228B is passed beneath the net and the halves 228A, 228B are then arranged so that interior faces 238A, 238B are in opposed relationship. The bolt 246 is passed through the stick 200 and is secured at its distal end by nut 250. The net is then sandwiched between the halves 228A, 228B and is maintained in a vertical plane.

Stick 200 allows for ease in assembly since the hinge 260 provides for automatic registration of the halves 228A, 228B in opposed relationship, with the openings through which the bolt 246 is passed being in ready alignment. Thus, one person may operate stick 200 more readily than stick 10.

C. Third Embodiment

Figure 6:
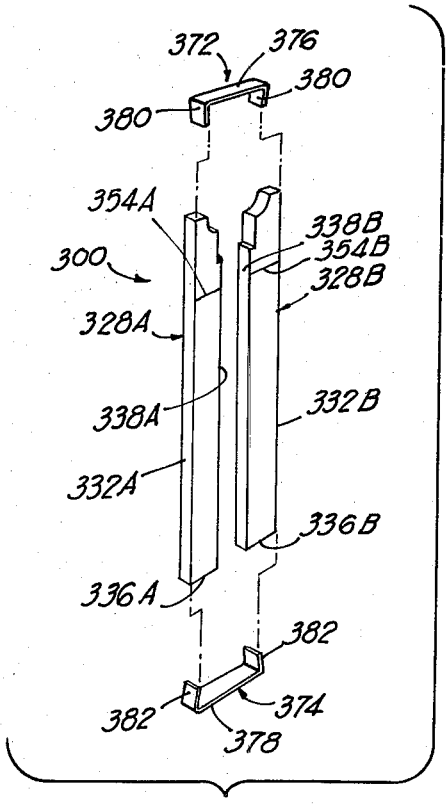
FIG. 6 is an exploded perspective view of the third embodiment of the present invention.

The third embodiment of the present invention is shown in FIG. 6 and is denoted generally by the numeral 300. Again, the halves 328A, 328B are the same as halves 28A, 28B except as noted below.

Means for detachably securing the halves 338A, 338B together include upper and lower spring clips 372, 374 which may be fashioned out of any suitable resilient material, such as metal or plastic. The clips 372, 374 are equally dimensioned and include elongated main portions 376, 378, each of which terminate in a pair of inwardly directed, opposed feet 380, 382.

In the operation of the third embodiment 300, the two halves 328A, 328B are positioned in opposed relationship so that interior faces 338A, 338B are in abutting engagement with both sides of the net. The bottom clip 374 is placed beneath halves 328A, 328B and attached to the bottom thereof by means of the interior surfaces of legs 382 gripping the front walls 332A, 332B adjacent the bottom surfaces 336A, 336B. The top clip 372 is similarly attached to the upper portion of halves 328A, 328B.

The length of halves 328A, 328B is less than the lengths of halves 28A, 28B because when the clips 372, 374 are attached to halves 328A, 328B, the distance between the top of clip 372 to the bottom of clip 374 must be 42 inches. Thus, the width of the main portions 376, 378 must be taken into account when determining the length of halves 328A, 328B. That means that the reference marks 354A and 345B, while indicating 36 inches from the bottom surfaces 336A, 336B, respectively, will be greater than that distance from surfaces 336A, 336B (by an amount equal to the width of main portion 378) in order that the reference marks 354A, 354B may be utilized to properly indicate height A.

D. Fourth Embodiment

Figure 7:
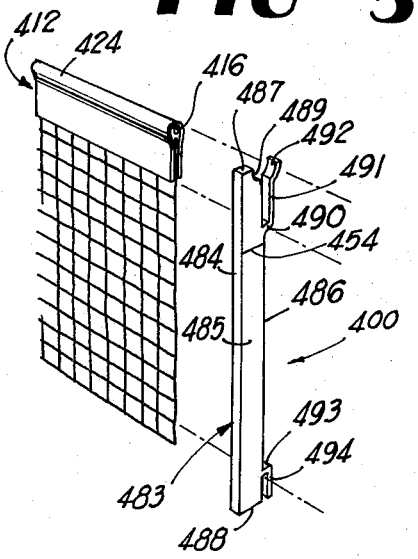
FIG. 7 is an exploded perspective view of the fourth embodiment.

The fourth embodiment is shown in FIG. 7 and is denoted generally by the numeral 400. It is a unitary element having a rectangular shaped support piece 483 with a forward face 484, sidewalls 485, interior face 486, top 487 and bottom 488. The length of support piece 483 is 42 inches. An arcuate groove 489 is longitudinally formed at the juncture of top 487 and interior face 486. Leg member 490 laterally extends from the interior face 486 and terminates in upstanding wall member 491 which has an outwardly directed, curved portion 492 at its upper end which terminates in an upper end that is flush with top 487.

Interior face 486, leg member 490 and upstanding wall member 491 form an upper channel having a first passageway which is dimensioned to receive the top cable 416 and band 424 of the net 412. The groove 489 and curved portion 492 define a passageway for the cable 416.

An oppositely directed lower channel is formed on support piece 483 adjacent bottom 488 by means of laterally extending element 493 which terminates in depending wall 494 that has a bottom surface which is flush with bottom 488. The lower channel has a second passageway that receives therein a horizontal strand of net 412. The first and second passageways are disposed within the same vertical plane. The reference mark 454 is utilized to determine the proper net height in the same manner as discussed above for marks 54A, 54B.

In the operation of the fourth embodiment 400, the band 424 is placed into the upper channel by inserting the wall member 491 in an opening of the net 412 which is located immediately beneath the lower edge of the band 424 and which is at the regulation 3 feet from the outside edge of the singles playing surface. The lower channel is then hooked onto the horizontal strand of net 412 which is next to the bottom edge of the net 412. In that manner, the interior face 486 engages one side of net 412 and the net 412 is maintained in a vertical alignment. If the support piece 483 is jarred by a ball or a player, it will remain erect due to the engagement by the channel members of the band 424 and the horizontal strand, respectively.

What I claim is:

1. A device to lift a tennis net to its regulation height above the ground for singles tennis play on a doubles court, the net being of the type having a top cable, a band surrounding the cable and netting vertically depending from the bottom of the band, comprising: a pair of rigid halves, each of said halves having a face; means on each of said faces for receiving said net therebetween; a flat lower surface on each of said halves which abuts the ground; and means for releasably securing together on opposite sides of said net said halves in an assembled condition so that said faces are in opposed relationship so as to maintain said net in a vertical plane with said net being compressed between said faces, wherein each of said receiving means includes each of said halves having a flat upper surface, said halves having oppositely directed, longitudinally extending arcuate grooves formed at the juncture of said upper surfaces and said opposed faces and having longitudinally extending L-shaped slots through said opposed faces beneath said grooves, said grooves defining a cavity to receive therein said cable and said slots defining a channel to receive therein said band.

2. A device as claimed in claim 1 wherein the radius of curvature of each of said grooves is $\frac{3}{8}$ of an inch.

3. A device as claimed in claim 1 wherein the distance from the bottom of each of said slots to each of said tops is $2\frac{1}{2}$ inches.

* * * * *